US009546559B2

(12) United States Patent
Jarrett, Jr. et al.

(10) Patent No.: US 9,546,559 B2
(45) Date of Patent: Jan. 17, 2017

(54) LOCK LINK MECHANISM FOR TURBINE VANES

(71) Applicant: General Electric Company, Schenectady, NY (US)

(72) Inventors: Harry McFarland Jarrett, Jr., Simpsonville, SC (US); Jayakrishna Velampati, Bangalore (IN); Andrew John Lammas, Greenville, SC (US); Laurie Ann Cribley, Simpsonville, SC (US); Saurabh Deshmukh, Bangalore (IN)

(73) Assignee: General Electric Company, Schenectady, NY (US)

( * ) Notice: Subject to any disclaimer, the term of this patent is extended or adjusted under 35 U.S.C. 154(b) by 628 days.

(21) Appl. No.: 14/048,724

(22) Filed: Oct. 8, 2013

(65) Prior Publication Data

US 2015/0098813 A1 Apr. 9, 2015

(51) Int. Cl.

| | |
|---|---|
| ***F01D 9/04*** | (2006.01) |
| ***F01D 17/16*** | (2006.01) |
| ***F04D 29/56*** | (2006.01) |
| ***F04D 29/64*** | (2006.01) |

(52) U.S. Cl.

CPC ..... *F01D 9/042* (2013.01); *F01D 17/162* (2013.01); *F04D 29/563* (2013.01); *F04D 29/644* (2013.01)

(58) Field of Classification Search

CPC ..... F01D 9/042; F01D 17/162; F01D 29/644; F01D 29/563; F01D 29/541; F01D 5/32

See application file for complete search history.

(56) References Cited

U.S. PATENT DOCUMENTS

| | | | | |
|---|---|---|---|---|
| 2,755,064 | A * | 7/1956 | Simonsen | F01D 9/042 415/209.3 |
| 3,004,750 | A * | 10/1961 | Broders | F01D 9/042 415/209.4 |
| 3,112,916 | A * | 12/1963 | Miller, Jr. | F01D 9/042 416/220 R |
| 5,211,537 | A | 5/1993 | Langston et al. | |
| 7,722,321 | B2 * | 5/2010 | Lhoest | F01D 9/042 415/209.3 |
| 8,075,264 | B2 * | 12/2011 | Depaepe | F01D 9/042 415/191 |
| 2010/0232936 | A1 * | 9/2010 | Mielke | F01D 17/162 415/160 |
| 2014/0147265 | A1 * | 5/2014 | Biemar | F01D 17/162 415/209.2 |

* cited by examiner

*Primary Examiner* — Richard Edgar
*Assistant Examiner* — Jesse Prager
(74) *Attorney, Agent, or Firm* — Nixon & Vanderhye P.C.

(57) ABSTRACT

A lock link for locking variable stage stator vanes in a compressor includes a substantially planar body portion having a slot formed on one edge and a narrow neck portion extending away from an opposite edge, the narrow neck portion adapted to seat in a corresponding slot in an adjacent lock link attached to an adjacent vane; and a profiled opening in the substantially planar body portion adapted to receive a key provided on a vane stem to prevent relative rotation between the vane and the lock link.

20 Claims, 6 Drawing Sheets

LOCK LINK MECHANISM FOR TURBINE VANES

BACKGROUND

This invention relates to turbine and/or compressor vanes and particularly to a mechanism by which all of the variable stator vanes in an annular row of such vanes can be locked in a desired angular orientation.

Variable stage vanes in multi-stage turbine compressors are used to address surge/stall conditions in the compressor. Typically, each vane is provided with a vane arm for rotating the vane, and the vane arms in the stage are connected to a sync or unison ring, bolted to the compressor case, that enables simultaneous rotation of all of the vanes in the stage. There are occasions, however, when testing establishes that the variable feature is not required for a particular stage of the multi-stage compressor. Converting a tested variable vane or airfoil arrangement in a selected stage to a fixed vane or airfoil arrangement in the same stage require another complete compressor test. This can be avoided, however, by locking the variable stage vanes from rotation in the respective stage, and several techniques have been utilized to effect the change from variable to fixed vanes.

For example, it has been proposed to use rigid links to lock the sync or unison ring but this approach is undesirable in that the heavy and cumbersome unison ring hardware is retained, thus also adding to the overall cost.

In order to save weight and eliminate some of the complexity of sync or unison rings, there have been attempts to eliminate the vane arm and sync or unison ring in favor of vane locks that join adjacent vanes and lock them in the selected position. See, for example U.S. Pat. No. 5,211,537. This approach is problematic in that the vanes have to be removed in order to install the vane locks, and to remove the vanes in the lower half of the turbine case, the rotor must be pulled from the case.

While there are many ways to lock a variable vane arrangement in place, there remains a need for a locking arrangement that does not alter the loaded condition of the vane during operation. In other words, the locking arrangement should load the vane in substantially the same manner as an unlocked vane during turbine operation. In addition, it would be advantageous to provide a single lock-link design for use with all vanes in the selected row of vanes.

BRIEF DESCRIPTION OF THE INVENTION

In one exemplary but nonlimiting embodiment, the invention provides a lock link for locking variable stage stator vanes in a compressor stator comprising a substantially planar body portion having a slot formed on one edge and a narrow neck portion extending away from an opposite edge, the narrow neck portion adapted to seat in a corresponding one of the slots in an adjacent lock link; a profiled opening in the substantially planar body portion; and at least one inwardly projecting load tab.

In another exemplary but nonlimiting embodiment, the invention provides a turbine system comprising a compressor; a turbine operatively connected to the compressor via a rotor; wherein the compressor comprises multiple stages, at least some of which comprise respective rows of variable stator vanes attached to a compressor case and further wherein at least one of the respective rows of variable stator vanes is provided with link locks for locking all of the variable stator varies against rotation, each lock link comprising a substantially planar body portion having a slot formed on one edge and a narrow neck portion extending away from an opposite edge, the narrow neck portion seated in a corresponding one of the slots in an adjacent lock link; and a profiled opening in the substantially planar body portion received over a complementary-shaped stem of a respective stator vane.

In still another exemplary but nonlimiting embodiment, the invention provides a compressor stator comprising at least one row of variable stator vanes attached to a compressor case, the stator vanes having radially outward stems projecting outside the compressor case, the stems provided with link locks for locking all of the variable stator vanes against rotation, each lock link provided with a substantially planar body portion having a slot formed on one edge and a narrow neck portion extending away from an opposite edge, the narrow neck portion seated in a corresponding one of the slots in an adjacent lock link; a profiled opening in the substantially planar body portion received over a respective one of the stems, the profiled opening and the stem shaped to prevent relative rotation therebetween; and a load tab on the lock link adapted to pry its respective stator vane or an adjacent stator vane in a radially outward direction toward the compressor case.

DETAILED DESCRIPTION OF THE INVENTION

Figure 1:
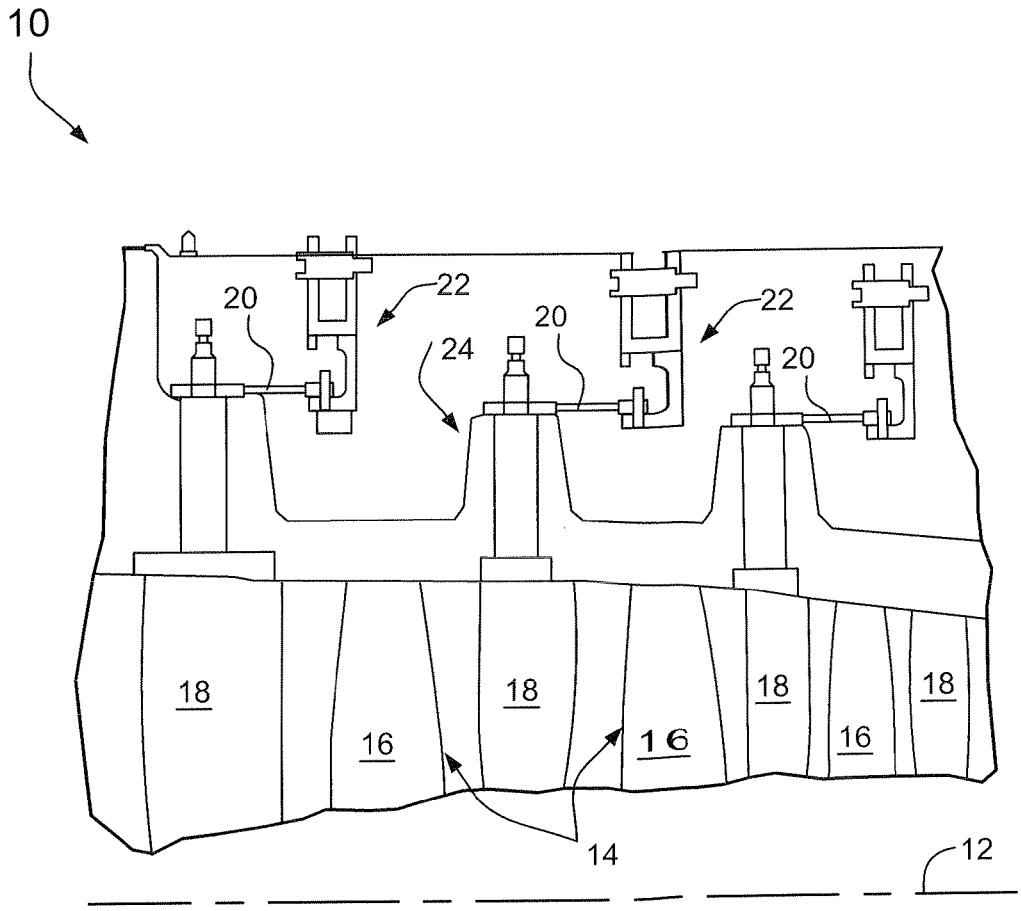
FIG. 1 (PRIOR ART)
FIG. 1 is a partial and simplified cross section of a conventional multi-stage, variable stator vane compressor.

FIG. 1 illustrates a multi-stage, variable vane compressor 10 including a rotor (represented by rotor axis 12) mounting plural wheels 14, each supporting a circumferential row of buckets 16. Between the wheels 14 are rows of fixed stator vanes 18 supported on the compressor case. In the compressor embodiment shown, each vane in the rows where the vanes are of the variable type, is provided with a vane arm 20 that attaches to a sync or unison ring assembly 22 that rotates relative to the compressor case 24 to simultaneously rotate each vane about its longitudinal axis to thereby uniformly change the vane angle throughout the entire row.

This invention, relates to a unique locking mechanism for locking otherwise variable vans in a selected angular position, using identical lock links about the periphery of the row.

Figure 2:
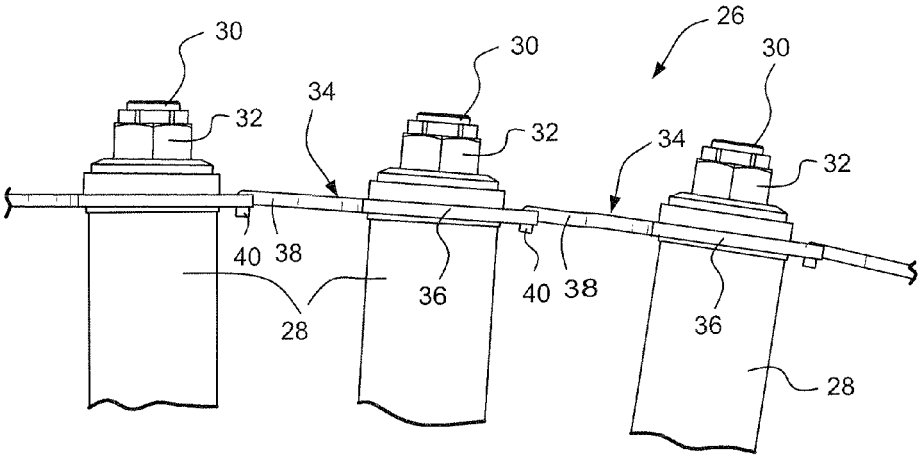
FIG. 2 is a partial end view of compressor vanes incorporating lock links in accordance with a first exemplary but nonlimiting embodiment of the invention, with the compressor case removed for the sake of clarity.
Figure 3:
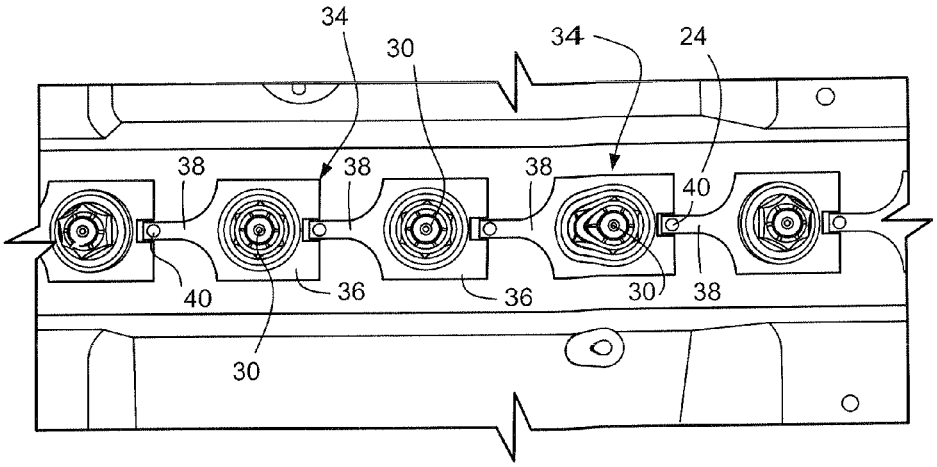
FIG. 3 is a plan view of the compressor vanes as shown in FIG. 2 but also illustrating the compressor case.
Figure 4:
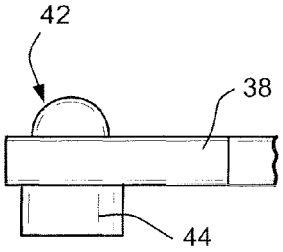
FIG. 4 is a partial end view of a lock link load tab in accordance with the first exemplary embodiment.
Figure 5:
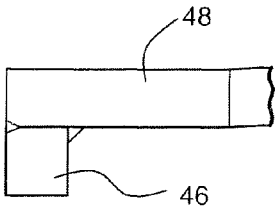
FIG. 5 is a partial end view of a lock link load tab in accordance with the second exemplary embodiment.
Figure 6:
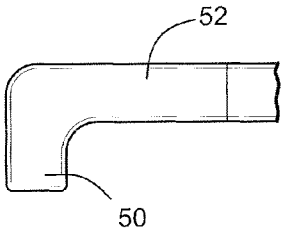
FIG. 6 is a partial end view of a lock link load tab in accordance with the third exemplary embodiment.

Turning to FIGS. 2 and 3, a row 26 of otherwise variable vanes 28 is supported from the compressor case 24 (FIG. 3), with threaded stems 30 projecting through the case and secured by fasteners (e.g., nuts) 32. It will be understood in the context of this invention that for a row of variable stator vanes supported in conventional fashion, the vane arms (see arms 20 in FIG. 1) and associated sync or unison ring have been removed). In accordance with a first exemplary but nonlimiting embodiment of the invention, self-locking links 34 are attached to the vane stems 30 of adjacent vanes, with one end of each link engaging the opposite end of the next successive link (as viewed, for example, in a right-to-left direction in FIG. 3). Each lock link 34 is formed to include a main body portion 36 and an extended, narrow neck portion 38 provided with a load tab 40 at its distal end. In this first exemplary embodiment, the load tab 40 projects radially inwardly as seen, for example, in FIG. 2. FIGS. 4, 5 and 6 show different possible load tab configurations including a presently preferred rivet 42 with flattened underside 44 (FIG. 4); load tab 46 welded to the narrow neck portion 48 (FIG. 7); and integral load tab 50 formed on the end of narrow neck portion 52.

Figure 7:
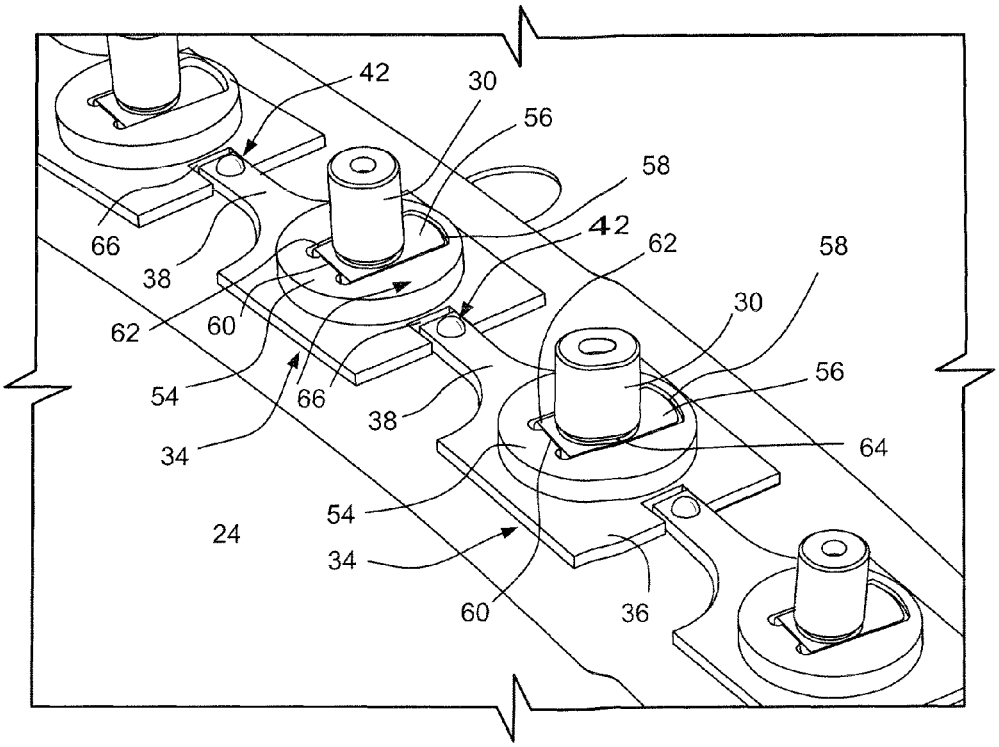
FIG. 7 is a partial perspective view of lock links in accordance with the first exemplary embodiment, with vane stem fasteners removed to show details of the lock links.
Figure 8:
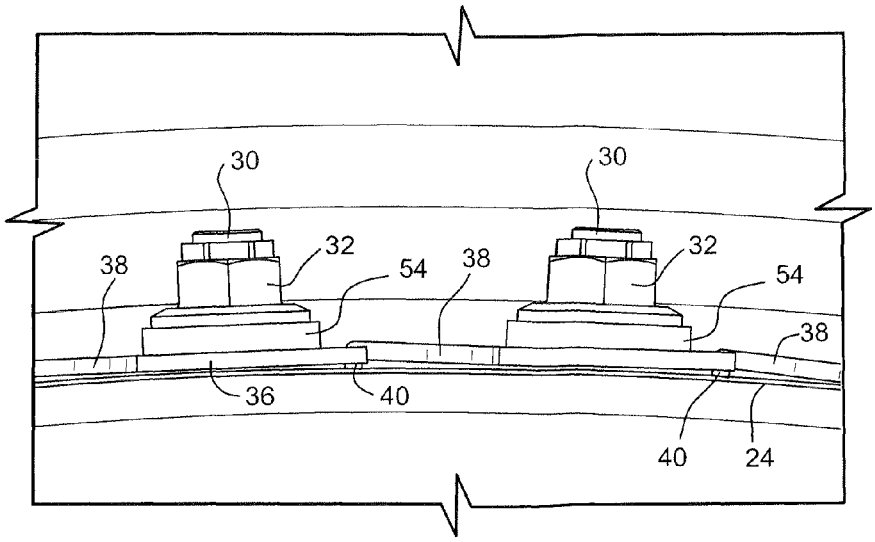
FIG. 8 is a partial end view of two of the vanes/lock links taken from FIG. 7 from outside the compressor case.

FIG. 7 shows the lock links 34 in more detail in that the fasteners 32 have been removed to reveal the manner in which a center pedestal portion 54 of the of the lock link 34 engages the vane stem 52. Specifically, in the exemplary embodiment, the vane stem is formed with an eccentric D-shaped key 56 which, in the exemplary embodiment, is generally rectangular in shape, with one rounded side 58 and an opposite flat side 60. The round pedestal portion 54 of the lock link 34 is provided with a cut-out 62 that mates with the key 56 thereby preventing any relative rotation between the lock link 34 and the vane stem 30 (and hence the vane 26). An undercut 64 is formed at the base of the stem 30 where it is joined to the key 56, and the undercut lies above the pedestal portion 54 of the lock link when the lock link is located over the key, as best seen in FIG. 8. The undercut provides a required amount of clearance or "play" to facilitate assembly and alignment of the vanes.

At the opposite end of each lock link 34, a slot 66 is provided to receive the narrow neck portion 38 of the adjacent lock link (as best seen in FIGS. 3 and 7), when the lock links are assembled on their respective vanes and engaged with each other as shown. It will be appreciated that, once the links are assembled as shown, the vanes 28 in the entire row are locked together against any differential or relative rotation by reason of the inter-engagement of the narrow neck portions 38 and slots 66. As the fastener 32 is tightened down against the pedestal portion 54 of a respective lock link, the load tab 42 loads against the outer surface of the case 24, and as the load tab flexes, the stem/vane is pryed in a radially-outward direction against the inner surface of the case 24, simulating the normal loading condition for a conventional variable vane connected to a vane arm. In other words, the load tab acts as a spring and prys the vane outwardly against the case, taking up the inherent loose tolerances between the various components required for assembly, including the assembly space created by undercut 64. Thus, the lock link system as described herein loads the vanes in the same way as the conventional vane arm/unison ring configuration, but in a simpler and less costly arrangement which eliminates the need for the vane arm and synch or unison ring. In addition, only a single lock link design is required for all of the lock links in the chosen compressor stage.

Figure 9:
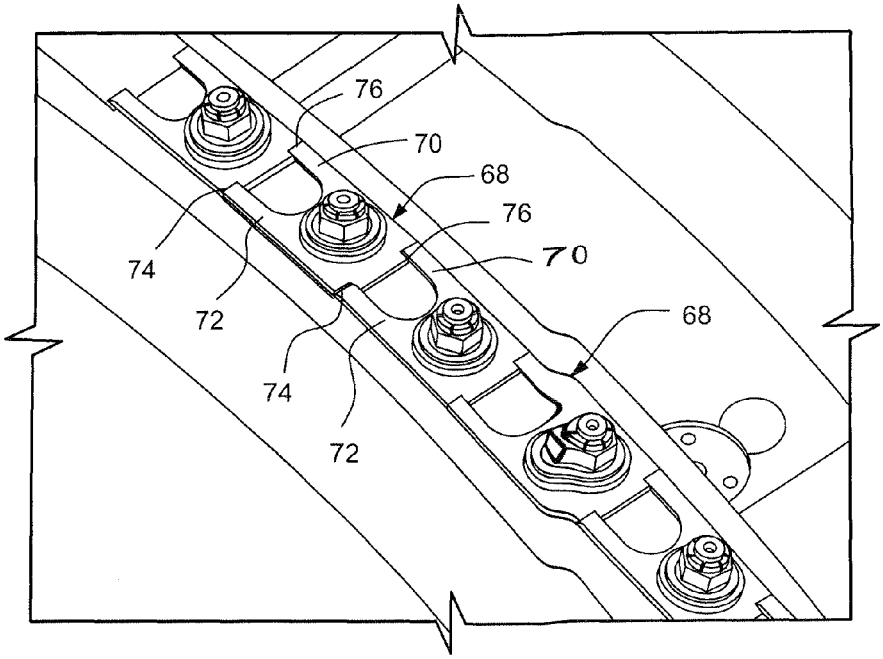
FIG. 9 is a partial perspective view of lock links in accordance with a second exemplary but nonlimiting embodiment, applied to a row of stator vanes.

FIG. 9 illustrates another exemplary embodiment where the lock link 68 is formed to include a pair of spaced narrow neck portions 70, 72 and associated load tabs (not visible in FIG. 9 but may be as shown in FIGS. 4-6) that engage within corresponding slots 74, 76 in the adjacent lock link. The spaced narrow neck portions and associated load tabs spread the forces on either side of the vane stem but the lock links otherwise function as described in connection with the embodiments illustrated in FIGS. 2-8.

Figure 10:
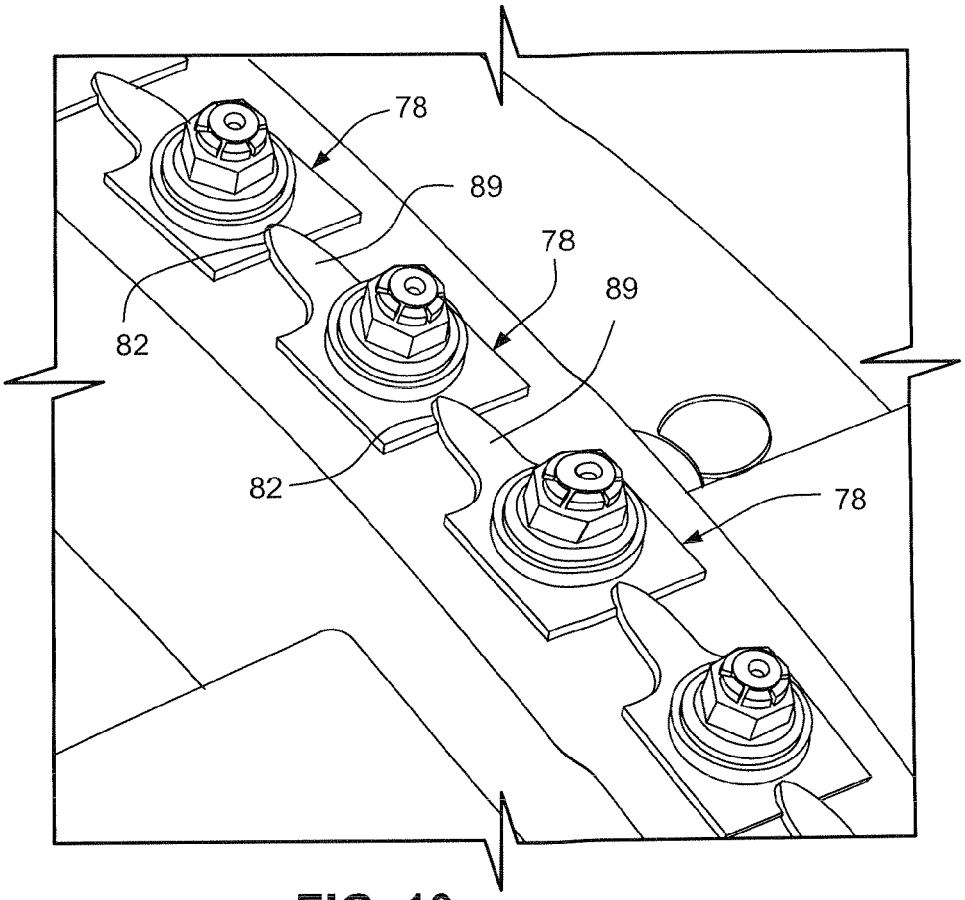
FIG. 10 is a partial perspective view of lock links in accordance with a third exemplary but nonlimiting embodiment, applied to a row of stator vanes.

FIG. 10 shows another variant where the lock link 78 is formed with a narrow-neck portion 80 having an oval-shaped distal end received within a correspondingly-shaped slot 82. Here again, it will be understood that any of the above-described load tab configurations can be provided at the distal end of the narrow-neck portion 80.

Figure 11:
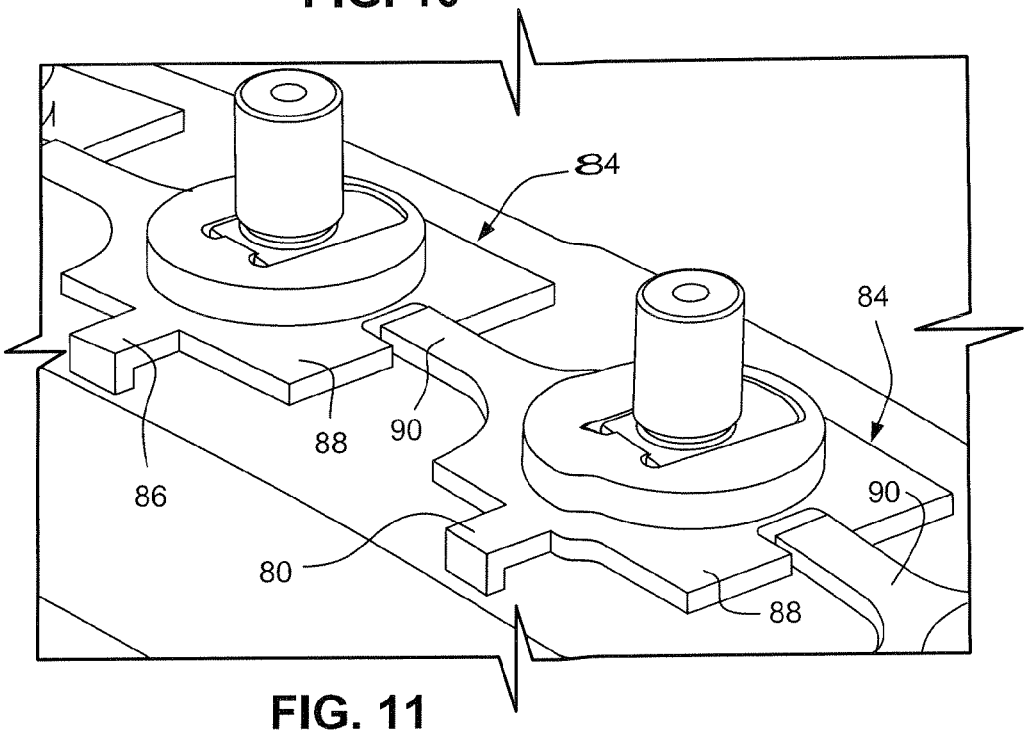
FIG. 11 is a partial perspective view of lock links in accordance with a fourth exemplary but nonlimiting embodiment, applied to a row of stator vanes.

FIG. 11 shows yet another exemplary embodiment where the lock link 84 is provided with a load tab 86 extending from the main body portion 88 of the lock link rather than at the distal end of the narrow neck portion 89. Here, the load tab 86 is formed along one of the side edges of the lock link main body portion, extending substantially perpendicular to the row of vanes, and perpendicular to the narrow-neck portion 89.

The embodiments described in FIGS. 1-11 are particularly beneficial in that the individual lock links can be installed without removing the vanes themselves.

Figure 12:
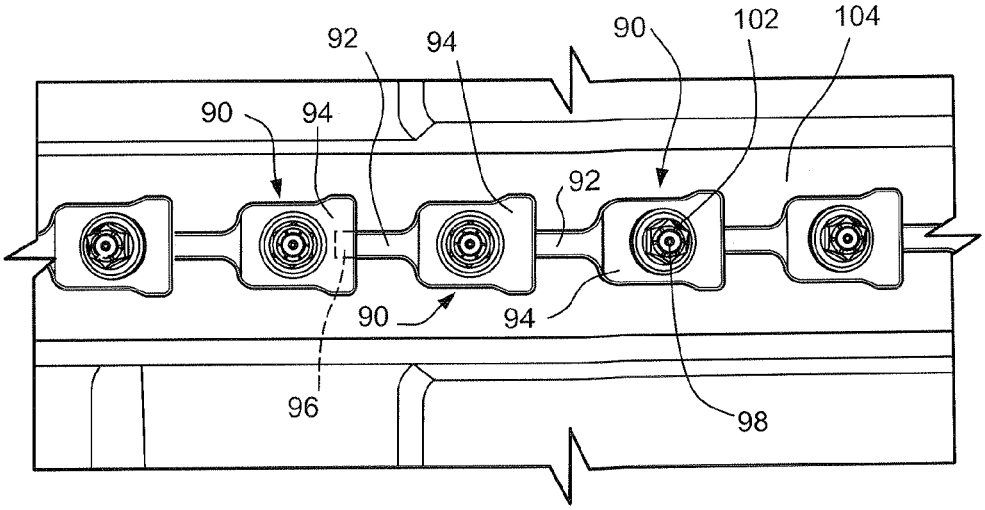
FIG. 12 is a partial plan view of lock links in accordance with a fifth exemplary but nonlimiting embodiment of the invention.
Figure 13:
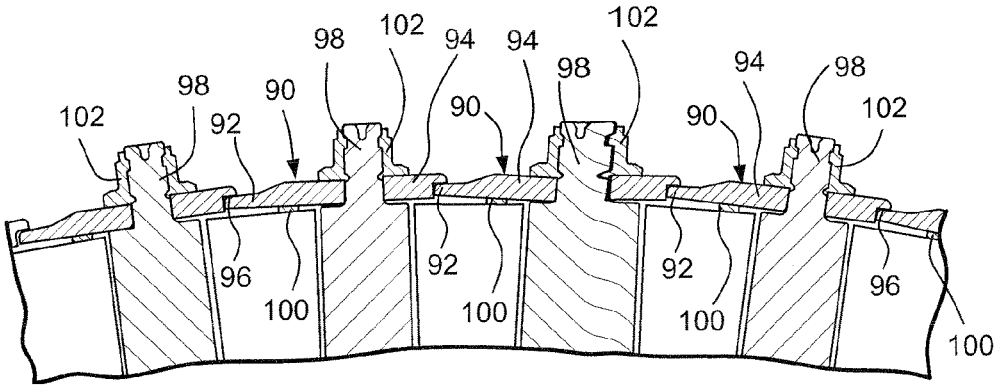
FIG. 13 is a partial end elevation of the lock links of FIG. 12.

In another exemplary embodiment, the lock links are configured to load the adjacent link and hence the adjacent vane. With reference to FIGS. 12 and 13, lock links 90 are shown attached to corresponding vane stems 98 in a manner similar to the embodiment shown in FIGS. 2-10. Here, however, it can be seen that the narrow-neck portion 92 of the lock link extends below the main body portion 94 of the adjacent lock link, and is received within a notch 96 formed on the underside of the adjacent lock link. In this embodiment, the notch is not "open" from top to bottom as in the lock link construction in FIGS. 1-11 but rather, the notch is "closed" on the top side of the lock link for the purpose described below. As in the previously described embodiment, the collective inter-engagement of the lock links and their respective vane stems 98 and engagement of the narrow neck portions 92 within the notches 96 prevents any relative rotation between the lock links and the corresponding vanes.

In addition, the load tab 100 is now provided on the underside of the lock link, substantially at the interface between the main body portion 94 and the narrow neck portion 92. The load tab 100 may be welded to the respective lock link, provided in the form of a rivet, or the entire lock link could be machined from a single blank. In this exemplary embodiment, the load tab serves as a fulcrum so that, as the nut 102 is tightened on the threaded stem 98 of the vane and thus pushing the main body 94 of the lock link 90 radially inwardly, the opposite end of the lock link, i.e., the narrow-neck portion 92*a*, pushes the adjacent lock link and its respective vane in a radial outward direction by reason of its engagement within the closed notch 96, and thus drawing the vane up against the interior surface of the compressor case. Note that the case 104 is removed from FIG. 13 for ease of understanding.

As in the first-described embodiment, the narrow-neck portion 92 could be formed with an oval-shaped distal end. Alternatively, the lock link 90 could be provided with a pair of laterally spaced narrow-neck portions (see FIG. 9) and/or a pair of axially-spaced load tabs 100 to spread the loads on the adjacent lock link in a manner somewhat similar to the lock link shown in FIG. 9.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

We claim:

1. A lock link for locking variable stage stator vanes in a compressor stator comprising:

a substantially planar body portion having a slot formed on one edge and a narrow neck portion extending away from an opposite edge, said narrow neck portion adapted to seat in a corresponding one of said slots in an adjacent lock link;

a profiled opening in said substantially planar body portion; and at least one inwardly projecting load tab, wherein the at least one inwardly projecting load tab is configured to press against a surface compressor case on which is seated the lock link and apply a radially outward bias force to the lock link.

2. The lock link of claim 1 wherein said inwardly projecting load tab is located at a distal end of said narrow neck portion.

3. The lock link of claim 2 wherein said load tab comprises a rivet.

4. The lock link of claim 2 wherein said load tab is welded to said narrow neck portion.

5. The lock link of claim 2 wherein said load tab comprises an integral bent end of said narrow neck portion.

6. The lock link of claim 1 wherein said radially inwardly projecting load tab is provided along a side edge of said substantially planar body portion.

7. The lock link of claim 1 wherein said profiled opening is substantially D-shaped.

8. The lock link of claim 1 wherein said slot is closed on an upper side such that the narrow neck portion of an adjacent lock link engages the underside of said slot.

9. The lock link of claim 8 wherein a load tab is provided on an underside of the lock link, substantially at an interface between the main body portion and the narrow-neck portion.

10. A turbine system comprising:

a compressor including a compressor case having an radially inward surface and a radially outward surface;

a turbine operatively connected to said compressor via a rotor;

wherein said compressor comprises multiple stages, at least some of which comprise respective rows of variable stator vanes attached to the compressor case and the variable stator vanes include airfoil sections having a radially outward end proximate he radially inward surface of the compressor case;

further wherein at least one of said respective rows of variable stator vanes is provided with link locks seated on the radially outward surface of the compressor case and the link locks are configured to lock all of said variable stator vanes against rotation about an axis of the respective variable stator vane, each lock link comprising a substantially planar body portion having a slot formed on one edge and a narrow neck portion extending away from an opposite edge, said narrow neck portion seated in a corresponding one of said slots in an adjacent lock link; and a profiled opening in said substantially planar body portion received over a complementary-shaped stem of a respective stator vane, and the narrow neck including at least one inwardly projecting load tab which is configured to press against the radially outward surface and apply a radially outward bias force to the lock link and to at least one of the variable stator vanes.

11. The turbine system of claim 10 wherein said narrow neck portion is provided with at least one radially inwardly projecting load tab at a distal end thereof.

12. The turbine system of claim 11 wherein said load tab comprises a rivet.

13. The turbine system of claim 11 wherein said load tab is welded to said narrow neck portion.

14. The turbine system of claim 11 wherein said load tab comprises an integral bent end of said narrow neck portion.

15. The turbine system of claim 11 wherein a radially inwardly projecting load tab is provided along a side edge of said substantially planar body portion.

16. The turbine system of claim 11 wherein said profiled opening is substantially D-shaped.

17. The turbine system of claim 11 wherein said slot is closed on an upper side such that the narrow neck portion of an adjacent lock link engages the underside of said slot.

18. The turbine system of claim 17 wherein a load tab is provided on an underside of the lock link, at an interface between the main body portion and the narrow neck portion.

19. The turbine system of claim 10 wherein each lock link is secured to a respective one of said complementary-shaped stems exteriorly of said compressor case.

20. A compressor stator comprising:

at least one row of variable stator vanes attached to a compressor case, wherein each of the variable stator vanes include an airfoil section having an end adjacent a radially inward surface of the compressor case, said stator vanes having radially outward stems projecting through said compressor case and radially beyond a radially outward surface of the compressor case, said stems provided with link locks for locking all of said variable stator vanes against rotation, wherein the link locks are seated on the radially outward surface, each lock link provided with a substantially planar body portion having a slot formed on one edge and a narrow neck portion extending away from an opposite edge, said narrow neck portion is seated in a corresponding one of said slots in an adjacent lock link;

a profiled opening in said substantially planar body portion receives a respective one of said stems;

said profiled opening and said stem are shaped to prevent relative rotation therebetween; and a load tab on said lock link abuts against the radially outward surface of the compressor case and is adapted to apply a radially outward bias force to the respective stator vane or an adjacent stator vane toward said compressor case.

* * * * *